US005645913A

United States Patent [19]

Rogers

[11] Patent Number: 5,645,913

[45] Date of Patent: Jul. 8, 1997

[54] FILM AND POUCH WITH PATCH OF HIGH ELONGATION

[75] Inventor: Kent Lee Rogers, Grove City, Ohio

[73] Assignee: W. R. Grace & Co.-Conn., Duncan, S.C.

[21] Appl. No.: 397,608

[22] Filed: Mar. 2, 1995

[51] Int. Cl.[6] ..... B32B 7/02; B65D 85/72

[52] U.S. Cl. ..... 428/77; 428/78; 428/212; 428/411.1; 428/500; 428/515; 428/516; 428/523; 428/35.2; 428/35.7; 426/106; 426/115

[58] Field of Search ..... 428/77, 78, 212, 428/411.1, 500, 515, 516, 523, 34.8, 35.2, 35.7, 911, 912; 426/106, 115

[56] References Cited

U.S. PATENT DOCUMENTS

| | | | |
|---|---|---|---|
| 4,521,437 | 6/1985 | Storms | 426/130 |
| 4,589,247 | 5/1986 | Tsuruta et al. | 53/550 |
| 4,603,793 | 8/1986 | Stern | 222/105 |
| 4,746,562 | 5/1988 | Fant | 428/213 |
| 5,288,531 | 2/1994 | Falla et al. | 428/35.2 |
| 5,302,402 | 4/1994 | Dudenhoeffer et al. | 426/129 |
| 5,325,995 | 7/1994 | Harrison et al. | 222/81 |

FOREIGN PATENT DOCUMENTS 1192164 8/1985 Canada .

OTHER PUBLICATIONS

FS Series Films, Cryovac Prod. Broch., pp. 1–2, copyright 1992.

Sclairfilm, CL–804, Dupont Product Broch., pp. 1–2, date not given.

Sclairfilm Polyolefin Film, Dupont Prod. Brochure, pp. 1–2, date not given.

The New Top Tap, Dupont Prod. Brochure, pp. 1–3, date not given.

*Primary Examiner*—Patrick Ryan
*Assistant Examiner*—Marie R. Yamnitzky
*Attorney, Agent, or Firm*—Mark B. Quatt

[57] ABSTRACT

A laminate suitable for forming into a pouch for pumpable products, the laminate including a thermoplastic packaging film, and a patch adhered to the packaging film, the patch including a thermoplastic material and characterized by an elongation at break, at 73° F. (ASTM D 882) of at least about 700% in each of the machine and transverse directions. The invention in another aspect is directed to a pouch comprising a pumpable product; a thermoplastic packaging film containing the pumpable product; and a patch adhered to the thermoplastic packaging film, the patch comprising a thermoplastic material and characterized by an elongation at break, at 73° F. (ASTM D 882) of at least about 700% in each of the machine and transverse directions.

16 Claims, 5 Drawing Sheets

FILM AND POUCH WITH PATCH OF HIGH ELONGATION

FIELD OF THE INVENTION

This invention generally relates to films, especially those used to make vertical form/fill/seal (VFFS) packages, and more particularly, the invention relates to films and pouches with a patch suitable for use in combination with a pour spout.

BACKGROUND OF THE INVENTION

Vertical form/fill/seal (VFFS) packaging systems have proven to be very useful in packaging a wide variety of flowable or pumpable products. These products include such items as chocolate syrup, spaghetti sauce, mayonnaise, and other food products, and can include non-food products as well. An example of such a system is the Onpack pumpable food packaging system sold by W.R. Grace & Co.-Conn. through its Grace Packaging group. The VFFS process is known to those of skill in the art, and described for example in U.S. Pat. No. 4,589,247 (Tsuruta et al), incorporated herein by reference. A flowable or pumpable product is introduced through a central, vertical fill tube to a formed tubular film having been sealed transversely at its lower end, and longitudinally. The pouch is then completed by sealing the upper end of the tubular segment, and severing the pouch from the tubular film above it.

The choice of packaging materials is important, and should be matched to the intended end use of the pouch. For foods such as tomato-based sauces, for example, a laminate of relatively low oxygen transmission is usually required in order to provide extended shelf life for the product. The FS laminates, such as FS 6055B, also sold by W.R. Grace & Co.-Conn. through its Grace Packaging group, are examples of packaging materials suitable for the VFFS process. The FS 6055 B is a high oxygen barrier laminate that offers extended shelf life. It is also a material that is capable of, and in fact often used in commercial applications where the food product is hot filled, typically at 180° F. to 200° F., into the formed pouch during the VFFS process. Thus, this material offers the pumpable food processor both long shelf life and thermal stability for many hot-fill food items. These laminates are described in e.g. U.S. Pat. No. 4,746,562 (Fant), incorporated herein by reference.

An alternative laminate is based on Sclair (tm) sealant film, an ethylene/alpha-olefin copolymer marketed by DuPont Canada, and described in e.g. U.S. Pat. No. 4,521,437 (Storms), incorporated herein by reference. A commercial monolayer film from DuPont Canada is FS-3. A commercial multilayer laminate is CL 303.

Several ways of dispensing the contents of such pouches at their point of use have been proposed. One is the use of an internal fitment, such as the Asept (tm) fitment distributed in the U.S. by the assignee of the present application, and disclosed in U.S. Pat. No. 4,603,793 (Stern) incorporated herein by reference. In use, a coupling device would be inserted through the pouch material to communicate with the internal fitment, and a conventional dispensing device would be connected to the coupling device for delivering measured portions of the contents of the pouch.

An alternative technique and apparatus for dispensing the contents of a pouch is the use of a pouring spout such as the Top-Tap (tm) pouring spout supplied by DuPont Canada, and described in differing embodiments in their Canadian Patent No. 1,192,164 (Obidniak) and U.S. Pat. No. 5,325,995 (Harrison et al), both incorporated herein by reference.

This latter system generally involves piercing the filled pouch with the sharp end (piercing nozzle) of a pouring spout, and driving the piercing nozzle into the pouch interior until the laminate forming the pouch wall engages the shoulder of the piercing nozzle. When this occurs, the plastic material forming the pouch will dispose around the shoulder of the nozzle, to be secured by a collar. The pouring spout can then be used to dispense the contents of the pouch.

In some cases, a packager may wish to forgo the use of internal fitments such as those described earlier, and use a pouring spout such as that disclosed in the Obidniak and Harrison et al patents. This has proven practical when using materials such as the Sclair film. Unfortunately, however, when the package designer wishes to take advantage of the benefits described above for the FS laminates, in connection with these pouring spouts, a practical problem arises. The inventor has found that although the FS 6055 B material can be successfully pierced using e.g. the Top-Tap (tm) nozzles, when the material is brought up and around the shoulder of the nozzle device, and secured by the collar, the material pulls away somewhat from the device. This results in a relatively high rate of "leakers", i.e. pouches that leak. Although "leakers" can occur for a variety of reasons, the focus here is the leakage occurring in the vicinity of the shoulder of the piercing nozzle.

The inventor has found that this difficulty in making reliable packaging can be remedied, while still using the FS film in combination with a pouring spout. A lower incidence of leakers results.

SUMMARY OF THE INVENTION

The invention in one aspect is directed to a laminate suitable for forming into a pouch for pumpable products, the laminate comprising a thermoplastic packaging film, and a patch adhered to the packaging film, the patch comprising a thermoplastic material and characterized by an elongation at break, at 73° F. (ASTM D 882) of at least about 700% in each of the machine and transverse directions.

The invention in another aspect is directed to a pouch containing a pumpable product, the pouch comprising a thermoplastic packaging film, and a patch adhered to the thermoplastic packaging film, the patch comprising a thermoplastic material and characterized by an elongation at break, at 73° F. (ASTM D 882) of at least about 700% in each of the machine and transverse directions.

DESCRIPTION OF THE PREFERRED EMBODIMENTS

Figure 1:
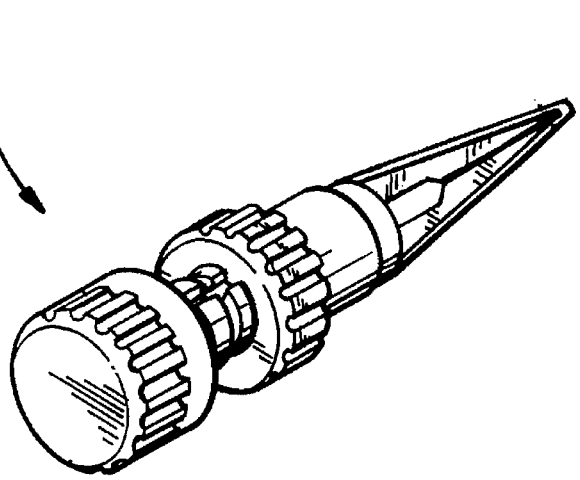
FIG. 1 (PRIOR ART)
FIG. 1 is a perspective view of a conventional pouring spout.
Figure 2:
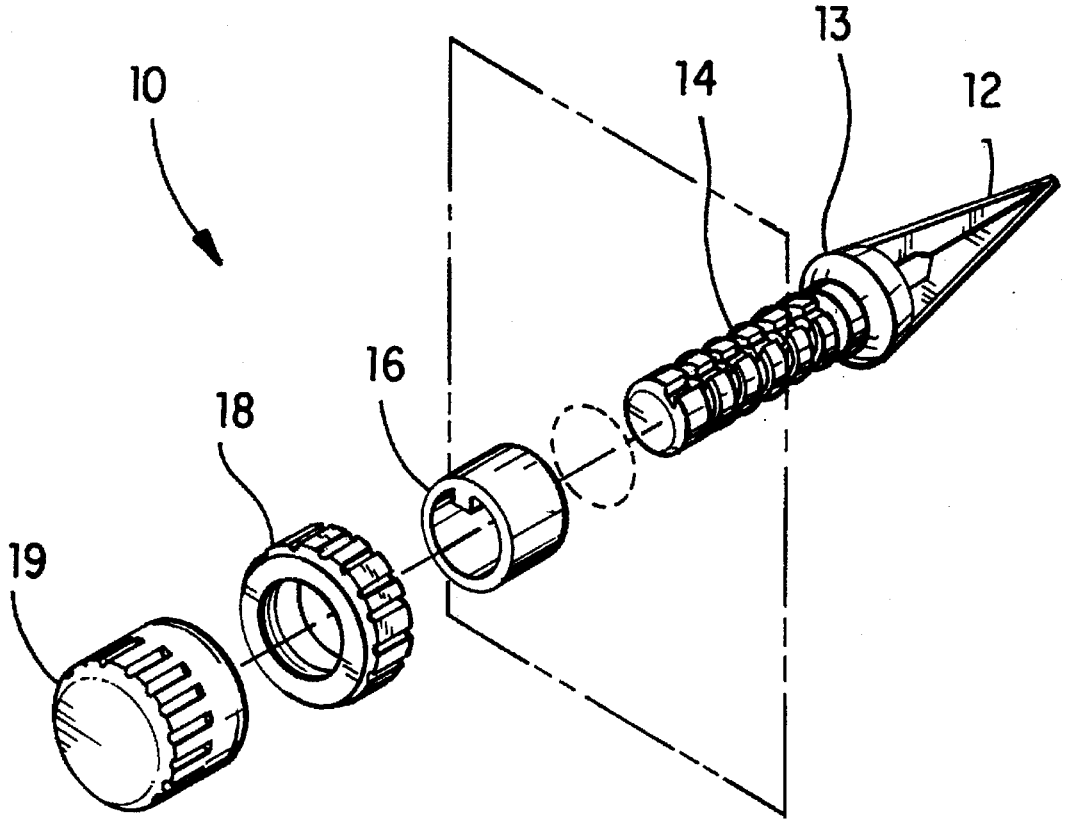
FIG. 2 (PRIOR ART)
FIG. 2 is a perspective blown-up view of the pouring spout of FIG. 1.

FIGS. 1 and 2 show a conventional pouring spout 10, as disclosed in Canadian Patent No. 1,192,164 (Obidniak). This pouring spout includes a pointed end 12, a shoulder 13, a threaded stem 14, a collar 16, a threaded retainer 18, and a cap 19.

Figure 3:
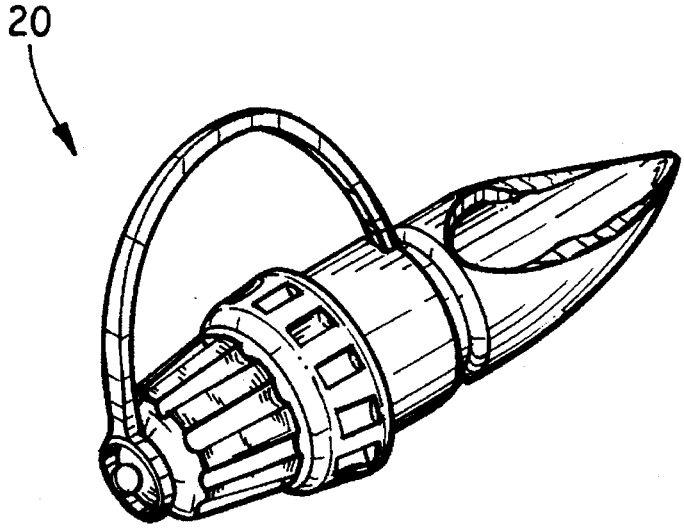
FIG. 3 (PRIOR ART)
FIG. 3 is a perspective view of another conventional pouring spout.
Figure 4:
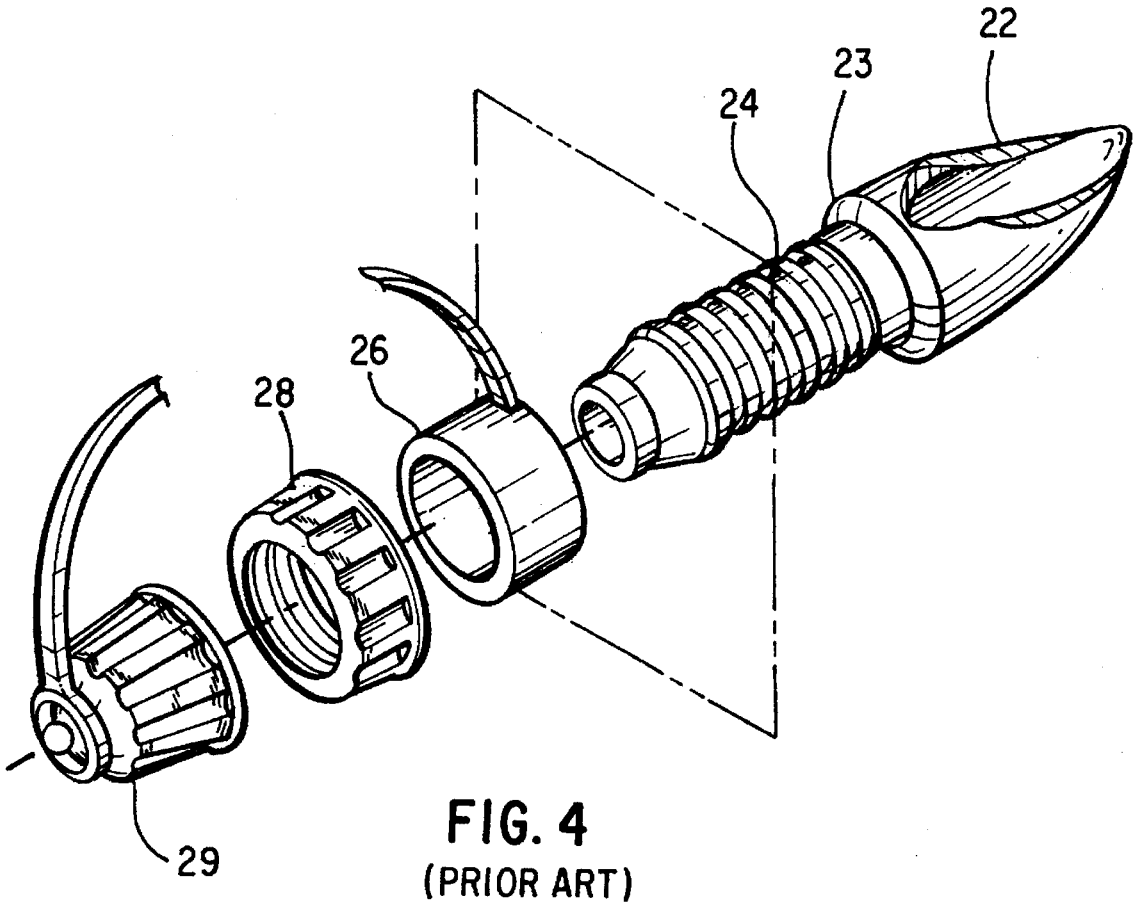
FIG. 4 (PRIOR ART)
FIG. 4 is a perspective blown-up view of the pouring spout of FIG. 3.

FIGS. 3 and 4 show another conventional pouring spout 20, as disclosed in U.S. Pat. No. 5,325,995 (Harrison et al). This pouring spout includes a pointed end 22, a shoulder 23, a threaded stem 24, a collar 26, a threaded retainer 28, and a cap 29.

Figure 5:
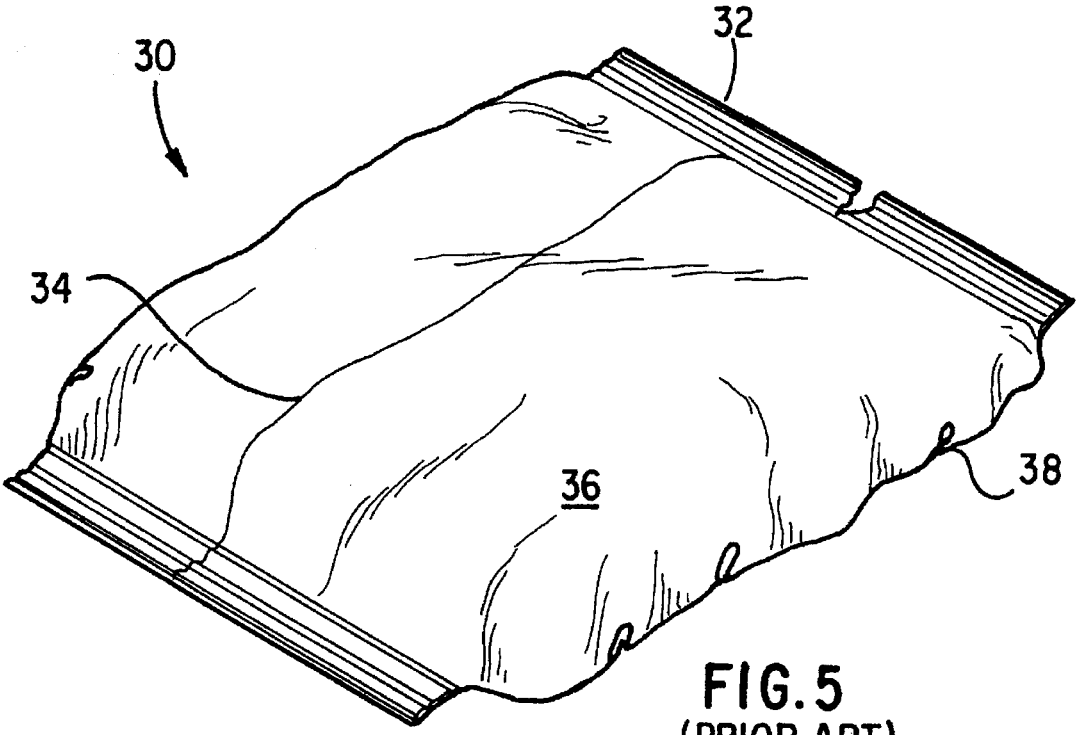
FIG. 5 (PRIOR ART)
FIG. 5 is a perspective view of a conventional VFFS pouch filled with a liquid food product.

FIG. 5 shows a conventional pouch 30. This pouch would typically be made on a VFFS or HFFS (horizontal form/fill/seal) process. It includes two transverse seals 32, and a longitudinal seal 34. Pouches with e.g. a clip closure, or by some other process than form/fill/seal, can also beneficially use the present invention. The pouch is shown filled with a flowable or pumpable product 36, typically a food product. The packaging material 38 from which the pouch is formed can be a monolayer or multilayer laminate, made by any suitable process, and comprising any suitable polymeric composition. Examples are the FS films available from the Cryovac Division of W.R. Grace, including FS 6055B, FS 6050, and FS 6035.

Figure 6:
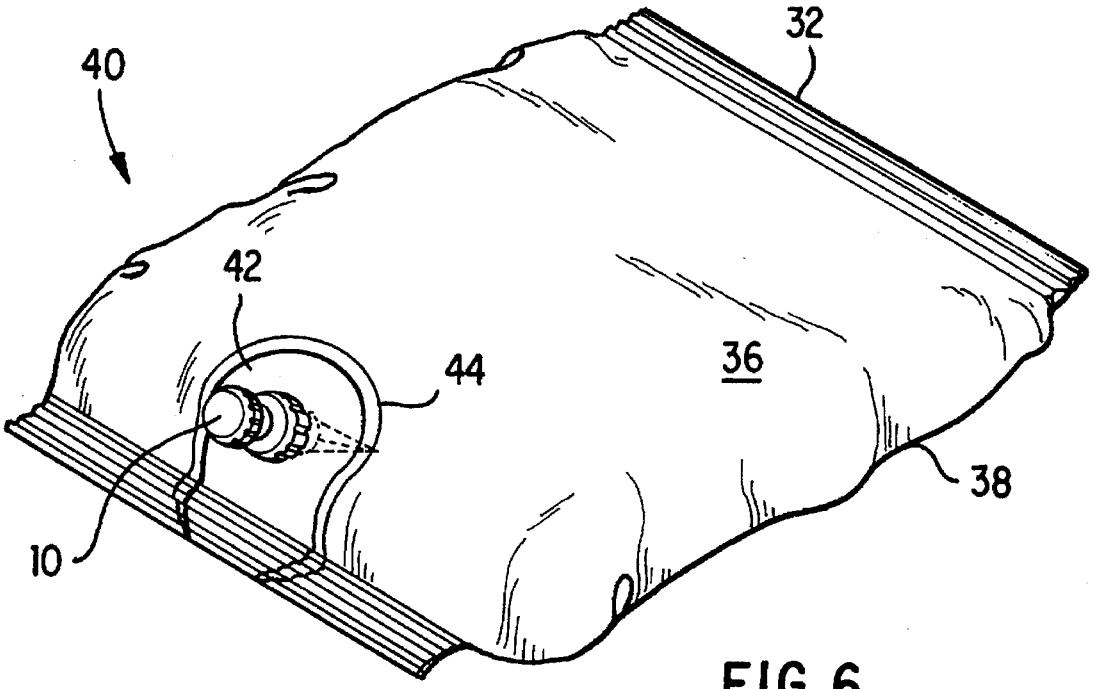
FIG. 6 is a perspective view of the VFFS pouch of FIG. 5, but with a patch adhered to one of the pouch walls in accordance with the invention, and the pouring spout of FIG. 1 inserted into the pouch.
Figure 7:
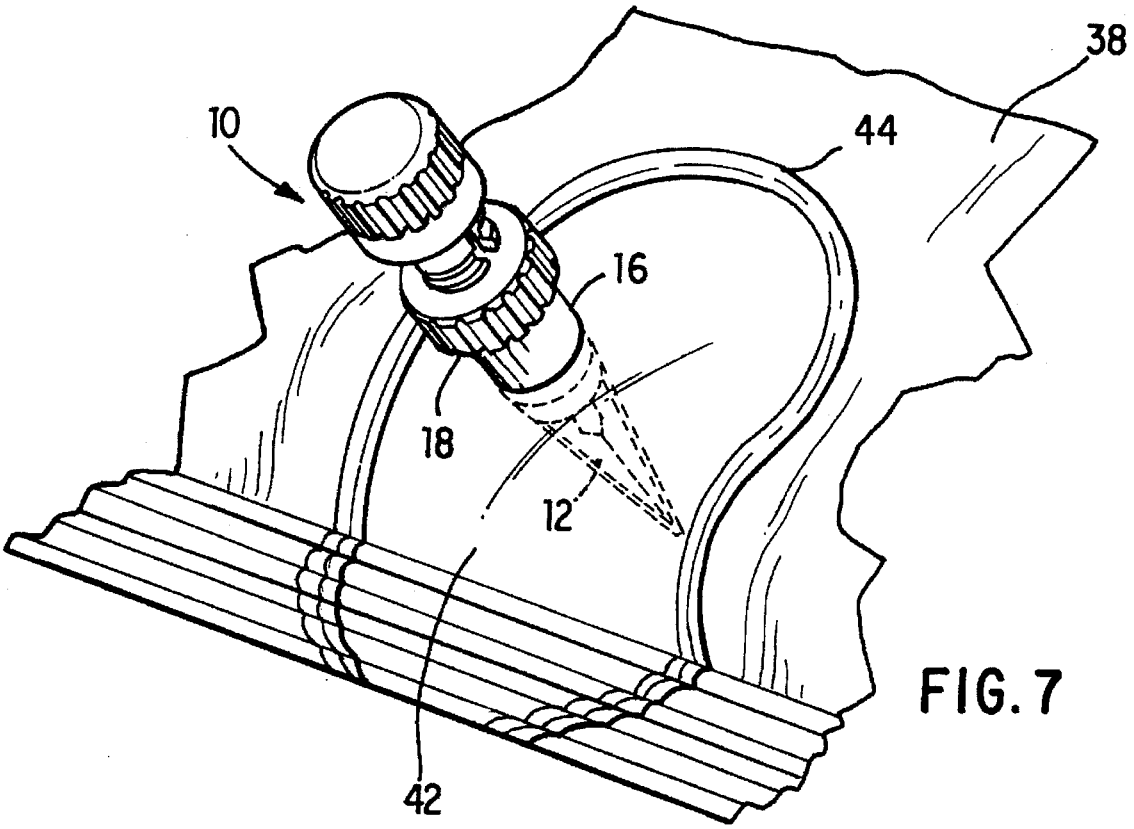
FIG. 7 is an enlarged view of a portion of the VFFS pouch of FIG. 6.

FIG. 6 shows a filled pouch 40 like pouch 30, but shown on the obverse side (and therefore not showing the longitudinal seal 34) and having a patch 42 adhered thereto. The patch can be adhered by adhesive, heat and pressure, surface treatment such as corona discharge, heat sealing (shown here as heat seal 44), or any other suitable process or combination of processes. The patch can be applied when the pouch material is made as a tubular or rollstock material; during converting into a pouch, either at a converter's facility or at the food processor's facility; or by an end-user. In this last case, the end-user, who can be a worker in an institutional or restaurant facility, could apply a patch to a filled pouch and then insert a pouring spout through the just-applied patch into the pouch. The patches can be applied manually, or by appropriate automated means such as indexing along a carrier film during the pouch forming and filling process. The patch could also be applied as a strip to the base pouch material 38 during or after extrusion of the pouch material, e.g. in a lamination process. In this latter case, the patch could extend the entire length of the pouch, but be narrower in width than the pouch, so that a pouring spout could be installed anywhere along the length of the strip. In FIG. 6, a portion of the patch is shown as integrated with one of the transverse heat seals 32 of pouch 30.

It should also be noted that two-web configurations resulting in two end seals and a transverse seal before filling, as well as other pouch designs can also benefit from the present invention.

The patch is made from any suitable polymeric material, e.g. FS 3 monolayer and CL 303 laminate made by DuPont Canada, as long as the patch is characterized by an elongation at break, at 73° F. (ASTM D 882) of at least about 700% in each of the machine and transverse directions. Polyolefins are preferred materials, such as ethylene copolymers e.g. ethylene alpha-olefin copolymers. These can be optionally combined, by blending or in a separate layer, with other materials. The inventor has discovered that high elongation materials can be pierced by the pouring spout 10 and properly conform around the shoulder of the spout, after securement with the threaded retainer, well enough to provide a reliable and usually leak-proof pouch.

In contrast, pouch materials such as the FS 6055 B, biaxially oriented films such as biaxially oriented nylon laminates, plastic/foil laminates, aluminum foil, PET films, and metallized laminates will typically not conform adequately to the pouring spout. The result is a relatively high incidence of leakers.

By using the high elongation patch, the benefits of a high barrier pouch material such as FS 6055 B are combined with the integrity of the patch material when a pour spout is used.

A preferred patch material is characterized by an elongation at break, at 73° F. (ASTM D 882) of at least about 750%, more preferably at least about 800%, in each of the machine and transverse directions. Preferred patch materials will range between 700% and 1000% elongation at break.

It has been found that material, through which the pouring spout is inserted, with an elongation at break, at 73° F. (ASTM D 882) of less than about 700% in each of the machine and transverse directions tends to be less desirable for use.

Although pouch material 38 can be characterized by any suitable elongation at break, the invention clearly will be of greatest benefit where the material 38 has a relatively low elongation at break but otherwise offers advantages as a pouch material in terms of cost and/or performance. Thus, preferred pouch materials will be characterized by an elongation at break, at 73° F. (ASTM D 882) of less than about 700%, more preferably less than about 650%, in each of the machine and transverse directions.

Figure 8:
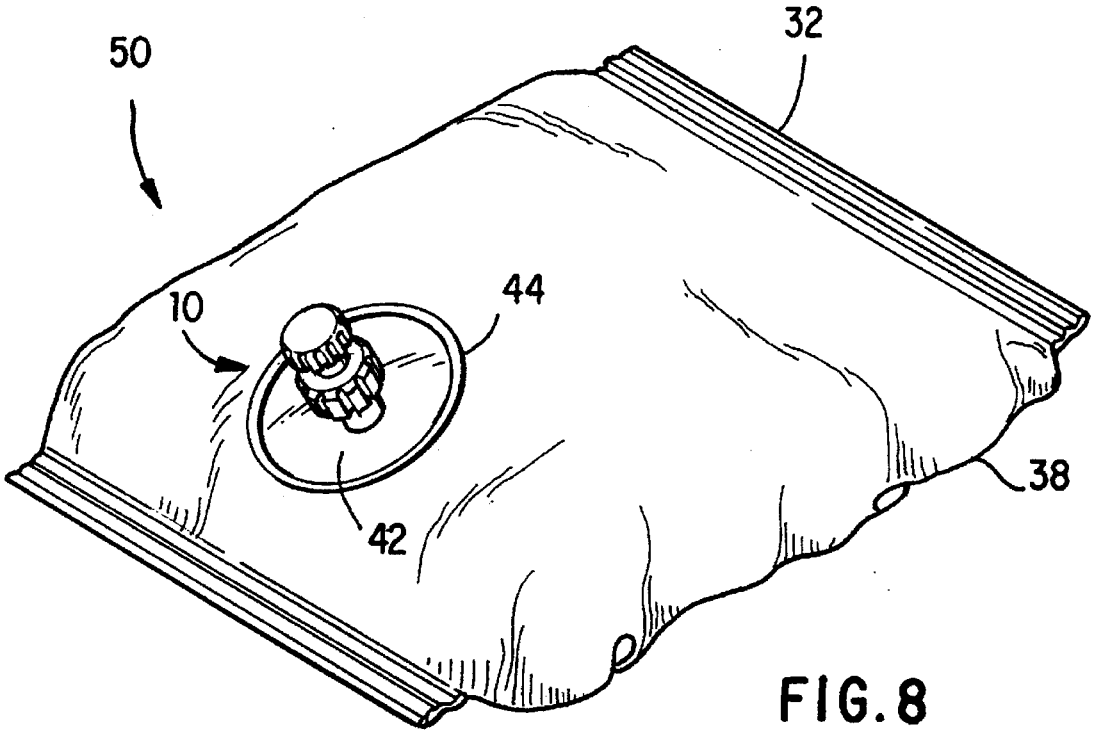
FIG. 8 is a perspective view of an alternative embodiment of the inventive laminate and pouch.

FIG. 8 shows a package 50 like package 40, but in which the patch 42 (and therefore the pouring spout after insertion) are located some distance from either transverse seal. The patch can be located on any suitable part of the package surface, including the corners of the package.

Figure 9:
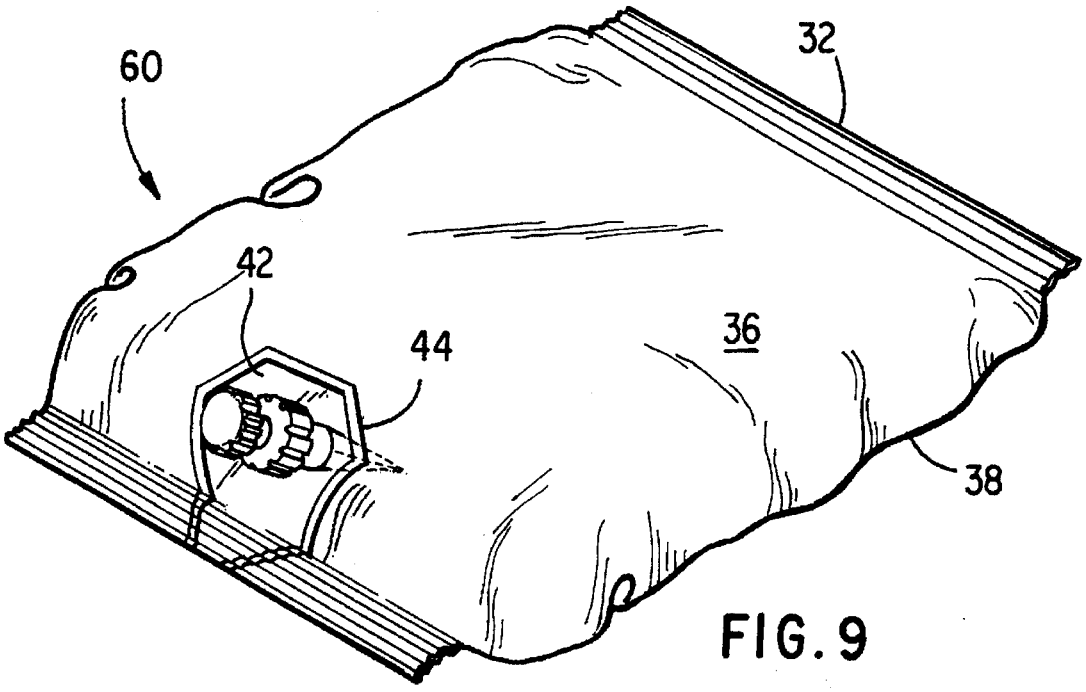
FIGS. 9 and 10 are perspective views of additional embodiments of the invention.

FIG. 9 shows a package 60 like package 40, but in which the patch 42 has a polygonal shape. The patch can be of any suitable geometry.

Figure 10:
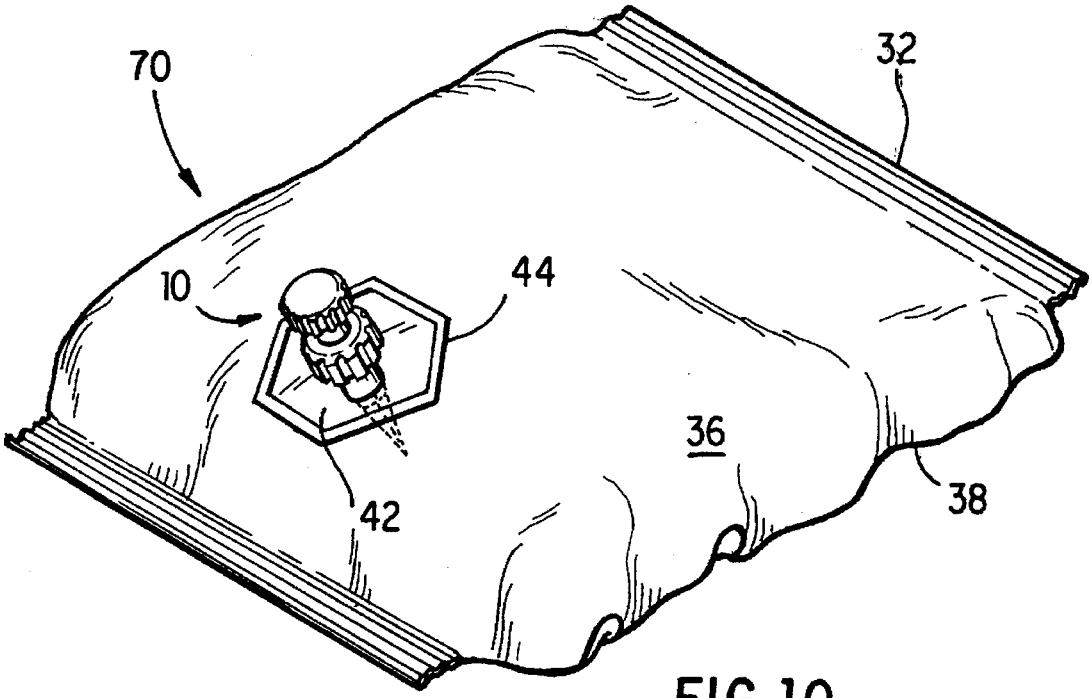

FIG. 10 shows a package 70 like package 60, but in which the patch 42 (and therefore the pouring spout after insertion) are located some distance from either transverse seal.

The invention can be further understood by reference to the Examples and Table 1 below. Four packages were made, in which a pouch containing a pumpable food product was made, and a pouring spout of one of the two types described above was inserted into the pouch. In the case of Comparative Example 1, the pouch material 38 was FS 6055 B, and no patch was used. In the case of Comparative Example 2, the pouch material 38 was biaxially oriented nylon laminate, and no patch was used. In Examples 1 and 2, a patch of FS-3 (Example 1) or CL-303 (Example 2) was applied manually to a pouch made from FS 6055 B, and the pouring spout in each case inserted into the pouch in the area of the patch. The results are shown below in Table 1.

TABLE 1

| | | Elongation at Break | | |
|---|---|---|---|---|
| Example | Film | Machine | Transverse | Result |
| Comp. 1 | FS 6055 B | 630% | 630% | leaker |
| Comp. 2 | biax nylon* | <50% | <50% | leaker |
| 1 | FS-3 | 840% | 930% | no leaker |

TABLE 1-continued

| Example | Film | Elongation at Break | | Result |
|---|---|---|---|---|
| | | Machine | Transverse | |
| 2 | CL-303 | 720% | 860% | no leaker |

*biax nylon refers to a multilayer laminate having a sealant layer, an oxygen barrier layer, and a biaxially oriented nylon layer. This laminate had virtually no elongation before breaking.

It is clear that if low elongation materials such as the FS 6055 B, and biax nylon were not suitable for use as the basic pouch material when used in conjunction with the pour spout, as shown in Comp. 1 and 2, they would be unsuitable as a patch as well.

The invention has been described in detail with particular reference to specific embodiments, but it will be understood that variations and modifications can be effected within the spirit and scope of the invention.

For example, although the pouring spouts discussed in the above description are specific commercial examples, those skilled in the art will understand that any pouring spout or piercing nozzle having a sharp end for piercing the pouch wall, and a "shoulder" onto or around which the patch material can be disposed, can be advantageously used in connection with the present invention.

Also, although the patch is preferably placed outside the pouch, it could also be placed, at some step prior to filling, inside the pouch material 38.

What is claimed is:

1. A laminate suitable for forming into a pouch for pumpable products, the laminate comprising:

a) a thermoplastic packaging film, wherein the thermoplastic packaging film is characterized by an elongation at break, at 73° F. (ASTM D 882) of less than 700% in each of the machine and transverse directions, and b) a patch adhered to the packaging film, the patch comprising a thermoplastic material and characterized by an elongation at break, at 73° F. (ASTM D 882) of between 700% and 1000% in each of the machine and transverse directions.

2. The laminate of claim 1 wherein the patch is characterized by an elongation at break, at 73° F. (ASTM D 882) of between 750% and 1000% in each of the machine and transverse directions.

3. The laminate of claim 1 wherein the patch is characterized by an elongation at break, at 73° F. (ASTM D 882) of between 800% and 1000% in each of the machine and transverse directions.

4. The laminate of claim 1 wherein the patch comprises an olefinic polymer.

5. The laminate of claim 1 wherein the thermoplastic packaging film is characterized by an elongation at break, at 73° F. (ASTM D 882) of less than about 650% in each of the machine and transverse directions.

6. The laminate of claim 1 wherein the thermoplastic packaging film comprises an olefinic polymer.

7. A pouch comprising:

a) a pumpable product;

b) a thermoplastic packaging film containing the pumpable product, wherein the thermoplastic packaging film is characterized by an elongation at break, at 73° F. (ASTM D 882), of less than 700% in each of the machine and transverse directions; and c) a patch adhered to the thermoplastic packaging film, the patch comprising a thermoplastic material and characterized by an elongation at break, at 73° F. (ASTM D 882) of between 700% and 1000% in each of the machine and transverse directions.

8. The pouch of claim 7 wherein the patch is characterized by an elongation at break, at 73° F. (ASTM D 882) of between 750% and 1000% in each of the machine and transverse directions.

9. The pouch of claim 7 wherein the patch is characterized by an elongation at break, at 73° F. (ASTM D 882) of between 800% and 1000% in each of the machine and transverse directions.

10. The pouch of claim 7 wherein the patch comprises an olefinic polymer.

11. The pouch of claim 7 wherein the thermoplastic packaging film is characterized by an elongation at break, at 73° F. (ASTM D 882) of less than about 650% in each of the machine and transverse directions.

12. The pouch of claim 7 wherein the thermoplastic packaging film comprises an olefinic polymer.

13. The pouch of claim 7 wherein the patch is heat sealed to the thermoplastic packaging film.

14. The pouch of claim 7 wherein the patch is adhesively adhered to the thermoplastic packaging film.

15. The pouch of claim 7 wherein the patch is corona bonded to the thermoplastic packaging film.

16. The pouch of claim 7 wherein the patch is bonded to the thermoplastic packaging film at a transverse seal of the pouch.

* * * * *